United States Patent [19]

Honmann

[11] 3,974,755

[45] Aug. 17, 1976

[54] AIR OUTLET

[75] Inventor: Winfried Honmann, Stuttgart, Germany

[73] Assignee: LTG Lufttechnische GmbH, Stuttgart, Germany

[22] Filed: May 8, 1973

[21] Appl. No.: 358,355

[30] Foreign Application Priority Data

May 8, 1972 Germany ..... 2222453

[52] U.S. Cl. ..... 98/40 D; 137/829

[51] Int. Cl.[2] ..... F24F 7/00

[58] Field of Search ..... 98/40 C, 40 D, 40 N, 98/40 A; 137/829

[56] References Cited

UNITED STATES PATENTS

| | | | |
|---|---|---|---|
| 2,528,130 | 10/1950 | Frisk et al. | 98/40 A |
| 2,814,978 | 12/1957 | Allou | 98/40 A |
| 3,099,949 | 8/1963 | Davidson | 98/40 D |
| 3,308,744 | 3/1967 | Schach | 98/40 D |
| 3,320,869 | 5/1967 | Schach | 98/40 D |
| 3,387,550 | 6/1968 | Thomson | 98/40 D |

*Primary Examiner*—William E. Wayner
*Assistant Examiner*—William E. Tapolcai, Jr.
*Attorney, Agent, or Firm*—Edwin E. Greigg

[57] ABSTRACT

An air outlet through which air is supplied to the room of a building or the like which includes a plurality of blower elements arranged in at least one row, with each element being independently angularly adjustable to supply air within a range of definite blast directions. The length of each individual blower element is maximally approximately 12-25 times greater than the thickness of the outwardly flowing stream of supply air.

19 Claims, 6 Drawing Figures

FIG.3
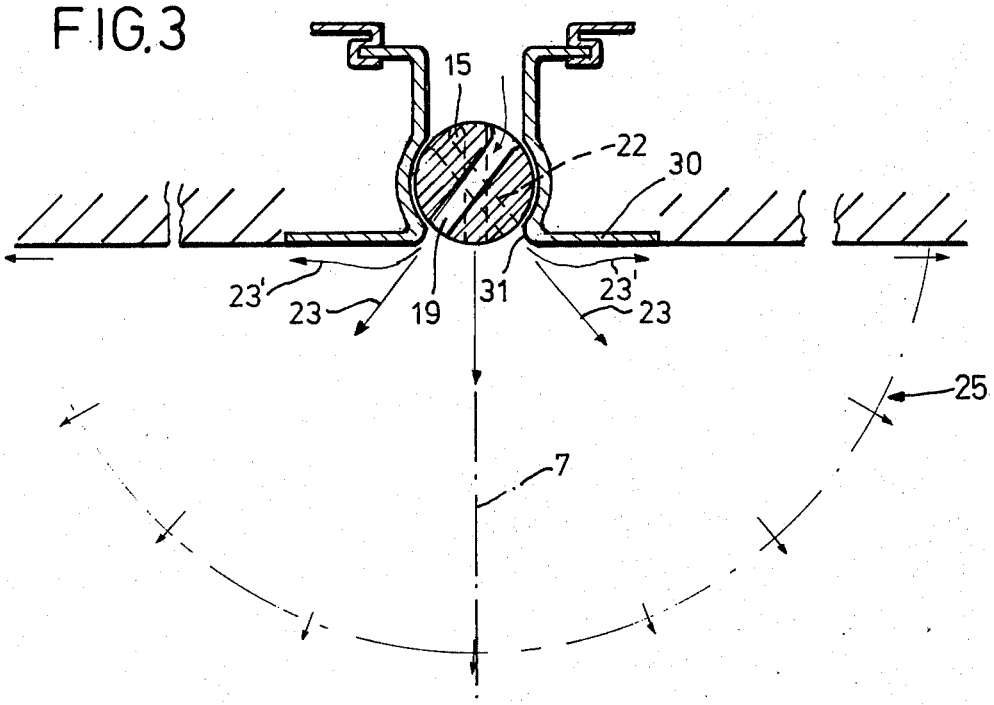
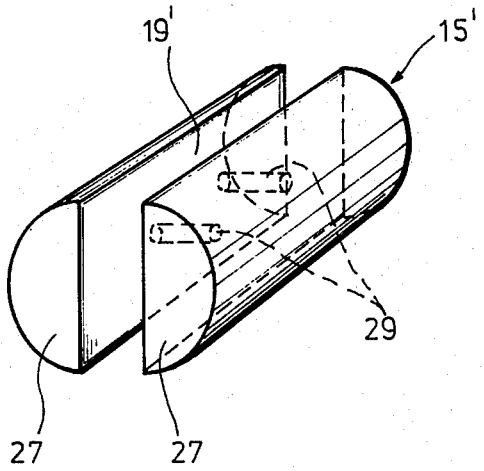
FIG.4

AIR OUTLET

BACKGROUND OF THE INVENTION

The present invention relates to an air outlet, and more particularly to an air outlet through which supply air is blown into a building space or the like, preferably from the ceiling thereof.

Such air outlets serve for the introduction of suitably pressurized treated supply air, which in general comes from a central air treatment station. The air is conducted through a system of ducts to the air outlets situated in the particular building and is passed through or blown through these air outlets into the rooms. The air treatment station is an air-conditioning installation or the like. In most cases, the supply air is heated or cooled depending on the season. But the supply air can also be treated in some other way.

According to a known ceiling air outlet a single long blowing element includes a rotatably supported body which is penetrated by a blowing slit extending over the entire length of the blowing element. This air outlet, while being distinguished by its constructional simplicity and by the possibility for adjustment of the blast direction of the air, has, however, the disadvantage, among others, that when the blast direction is adjusted to be inclined with respect to the plane of the ceiling, the supply air which streams outwardly from the blowing slit adjoins the neighboring ceiling surface because of the Coanda-effect and does so up to relatively steep blast angles. As a result, the supply air can be introduced into the room either only very steeply downwardly or adjacent to the ceiling. In practice, this results in the fact that heated supply air can be blown out of the air outlet only steeply downwardly since one may not introduce it exclusively along the ceiling because of its buoyancy, whereas cooled air can be introduced only along the celing since one may not blow it out exclusively steeply downwardly because of the strong draft which it would otherwise cause.

Furthermore, air outlets are known which are provided with a plurality of immovably disposed air outlet apertures whose blow directions diverge relative to one another. These are disadvantageous also in that, among other things, different adjustment possibilities do not exist for the blast directions of warm and cooled supply air. In addition, the outward flow conditions are in many cases unsatisfactory, for example, it is impossible to achieve an approximately flat 180° outwardly flowing air current or stream using such air outlets.

OBJECTS AND SUMMARY OF THE INVENTION

It is therefore a general object of the present invention to provide an air outlet which does not exhibit the disadvantages of the known air outlets.

It is a more specific object of the present invention to provide an air outlet which, while simply constructed, can blow supply air into the room along adjustable blast directions so that different outwardly flowing stream conditions which are particularly favorably fitted to prevailing individual requirements, or to other requirements, can be selected.

It is another object of the present invention to provide an air outlet which can be selectively adjusted so that, when installed in a ceiling, the entire supply air can either be exhausted selectively downwardly or either vertically or in a steeply diverging fashion, or so that the entire supply air can be blown into the room whereby, because of the Coanda-effect, it adjoins the ceiling and flows along the ceiling in one, or two mutually opposed, directions, or so that the supply air can be blown into the room in one or several directions which are obliquely inclined to the ceiling, in particular in several air streams which diverge relative to one another without the occurrence of adhesion of the supply air to the ceiling, or so that one can set any desired combination of the previously mentioned different possibilities where, preferably, the air outlet can be adjusted so that an approximately flat 180° current or stream of the supply air is achieved in the far field of the supply stream, that is, at some greater distance from the air outlet, for example, at a distance of 1 meter.

These and other objects are accomplished according to the present invention by the provision of an air outlet of the type previously mentioned, which includes a plurality of blower elements arranged in at least one row, with each being capable of delivering a stream of supply air in a definite and angularly adjustable blast direction and in which the blast directions, with the blast directions of the various blower elements being independently angularly adjustable, and with the length of an individual blower element being maximally approximately 12 – 25 times greater than the thickness of the outwardly flowing stream of supply air. In particular, it is provided that the length of the blower elements be approximately 2 – 12 times, preferably 10, or even, for example, 5 – 7 times greater than the thickness of the outwardly flowing stream of supply air.

BRIEF DESCRIPTION OF THE DRAWINGS

FIG. 3 illustrates the portion of FIG. 2 in which the blower elements are adjusted to several and different angular positions;

FIG. 4 illustrates an alternate embodiment of a blower element which also can be provided in the air outlet according to FIGS. 1–3;

DESCRIPTION OF THE PREFERRED EMBODIMENTS

Figure 1:
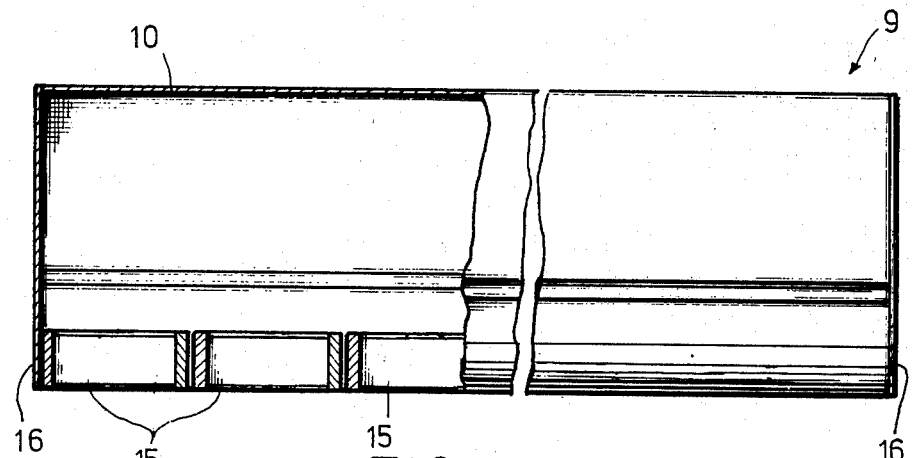
FIG. 1 illustrates a partly sectional, broken, side-elevational view of an air outlet according to the present invention.

In the following description it is assumed, for simplicity, that the air outlet is built into the ceiling of a room and that the blast directions are taken relative to the plane of the ceiling or to their normals. The normal to the ceiling is the downward direction perpendicular to the ceiling. If, on the other hand, the air outlet is built into a side wall of a room or the like, then the terms "plane of the ceiling" or "normal to the ceiling" are to be replaced by "plane of the wall" or "normal to the wall".

According to the present invention, the length of an individual blower element is chosen so that if it were to blow out supply air by itself, it could do so obliquely downwardly or inclined to the plane of the ceiling in an angular region of 40° – 50° without having the Coanda-effect occur, because of the short length of the blower element. It is assumed in this that the supply air is blown out through a slit which extends entirely or substantially over the length of the blower element or through a plurality of substantially equivalent air outlet apertures contained in this slit. If, on the other hand, several blower elements, disposed at a short distance behind one another, are set into the same blowing direction, and supply air is exhausted therefrom simultaneously, then, in otherwise unaltered conditions, the Coanda-effect would occur, i.e. then the stream of supply air blown out by the totality of these blower elements will be caused to adjoin the ceiling because of the Coanda-effect and will stream along the ceiling even though it is not exhausted parallel to the ceiling. A characteristic of the air outlet according to the present invention is, therefore, that it has regions within the blowing angle range in which one can achieve an adjoining of the supply air stream to the ceiling because of the Coanda-effect, or one can prevent it by either adjusting several sequentially arranged blower elements in approximately the same blowing direction, whereas if one reduces the number of these approximately identically adjusted blower elements, if necessary to one single blower element, then the Coanda-effect no longer occurs, so that then the set blowing angle of the blower element controls the streaming direction in which the supply air streams into the room through this blower element. For this purpose, it has been found that the maximum length of the blower elements, depending on the thickness of the outwardly flowing air stream or streams, may be approximately and maximally 12 – 25 times greater than the thickness of the outwardly flowing air stream or streams. This will be illustrated by the following example.

In an experimental model there was arranged a plurality of cylindrically-shaped blower elements in a row. The individual blower elements were adjacent to one another in the row. Each blower element had a diameter of 20 mm and a length of 50 mm, and each was penetrated by a blowing slit of rectangular cross section and of a length of 48 mm. At an angular position of the blowing slit of 45° with respect to the plane of the ceiling, a convexly curved surface of a mounting structure with a radius of curvature of 5 mm became situated opposite to ⅓ of the width of the blowing slit of the blower element. This convex surface, which forms a portion of the surface of a circular cylinder, extended parallel to the longitudinal sides of the blowing slit. If the supply air was exhausted or blown out of a single blower element when the blower element was in this position, it was observed that the Coanda-effect did not occur. If the supply air were exhausted or blown out of two adjacent blower elements simultaneously, the Coanda-effect also could not occur spontaneously. If, on the other hand, three such sequentially and contiguously arranged blower elements exhausted the supply air in this blowing direction, the Coanda-effect always occurred. In this experimental model the width of the blowing slits and therefore the thickness of the supply air streams was 8 mm. The Coanda-effect was observed to occur with a total length of the blower elements of between 10 – 15 cm. Given a thickness of the supply air stream of 8 mm therefore, the maximum permissible ratio of the length of the blower element to the thickness of the outwardly flowing or exhausting supply air stream was approximately 12 to 17:1. If the thickness of the air stream or streams changes, then other maximally permissible ratios can result. It has been found that, in general, the maximum value of this ratio may lie within limits of approximately 12:1 to 25:1. It is, of course, suitable not to dimension the blower elements at the permissible upper limit, but rather that the blower elements be shorter than would be maximally permissible, merely for reasons of reliability and tolerance. In addition, to proceed in this fashion, provides greater possibilities for variations. Preferentially, it can be advantageously provided in practice that the length of the blower elements be chosen so that it is approximately ⅓ to ½ of the maximum permissible length.

The present invention makes it possible to vary the supply air stream which is formed to stream downwardly from the air outlet in a manner that is not possible with known air outlets. If heated supply air is exhausted, then it can, for example, be blown out of the room exclusively downwardly perpendicular to the ceiling and one can, if necessary, achieve an air curtain. One can also exhaust the heated supply air in such a way that it expands downwardly, for example, in an angular region of ± 45° relative to the normal to the ceiling and it does so without being adjoined to the ceiling. For this purpose, for example, the blowing angle of the blower elements, relative to the normal to the ceiling, can be set, beginning with the first element, as follows: + 45°, − 45°, 0°, + 45°, − 45°, + 45°, − 45°, 0°; . . .

If one wishes to exhaust the entire supply air so that it adjoins the ceiling by virtue of the Coanda-effect, then, for example, these elements can be adjusted as follows: + 45°, + 45°, + 45°, − 45°, − 45°, − 45°; . . .

If one wishes to achieve, in the above-described test model, an approximately planar 180° stream, then the blower elements can, for example, be adjusted as follows: + 45°, + 45°, + 45°, − 35°, − 35°, 0°, + 35°, + 35°, − 45°, − 45°, − 45°; . . .

It should here be noted that in these examples, the above specified array of angular adjustments can be repeated or adjustments deviating from this array can be utilized for the remaining blower elements.

As is evident from the preceding description, the air outlet is to be constructed in such a way and is to be disposed in the ceiling or a wall in such a way that, if desired, the Coanda-effect may be achieved by simultaneous adjustment of several adjoining elements if a flow of the supply air or a part of the flow of the supply air is to adjoin the ceiling. The present invention is not so limited however, because the outlet, according to the invention, is even advantageous when the exhaust orifices of the blower elements are disposed at a distance from the surface of the ceiling or of some other wall surface that the supply air cannot be made to adjoin the ceiling or the wall. On the other hand, if it is designed, as is provided preferentially, for the flush installation in a ceiling or wall, then by appropriate adjustment of the blower elements, the Coanda-effect can occur or can be prevented, as desired.

As a consequence, the present invention makes it possible to vary the exhaust conditions of the air outlet in a great variety of ways and under all occurring conditions and circumstances, optimum blower conditions can be selected. The user, therefore, has at his disposal an air outlet which gives him the possibility to select, in a measure not previously possible, to optimally adjust the exhaust conditions for the prevailing circumstances and other conditions. Since rooms in buildings generally require several such air outlets, further possibilities are realized to vary the exhaust conditions differently by differently adjusting the blower elements of the air outlets in the room.

The blower elements may be of any suitable construction, preferably separate constructional elements which are mounted rotatably or pivotably. The axis of rotation or the pivoting axis can be advantageously provided parallel to but at a distance from the plane of the air outlet orifice or orifices or in some cases may lie suitably approximately in this plane. It has been shown to be particularly advantageous to use cylindrically-shaped blower elements which are arranged in a row and are rotatably mounted in common, partly cylindrical, bearing shells. In general, it is suitable to design the blower elements as nozzles or similar to nozzles.

However, it is not absolutely necessary that the blower elements be, in all their parts, separate from one another. Rather, in many cases, it can be advantageously provided that the blower elements have a common air shaft which preferentially may have a single penetrating slit-shaped air outlet aperture. In that case, the adjustment of the blowing angle of the individual blower elements is adjustable by means of movable air-guide-means which are disposed in the air shaft or in some cases outside of the air shaft, but preferably by flaps disposed in the air shaft. What is important in this constructional method, however, is that in the direction of the exhaust aperture of the air shaft, a plurality of such air-guide-means are disposed one after the other, where the length of each air-guide-means determines the length of the blower element and where the air-guide-means can be adjusted in differing positions so that, if desired, the supply air also emerges in differing directions from the air outlet. In that case, it is in many instances not required to dispose separating walls in the interior of the air shaft and between the air-guide-means which define the individual blower elements, even though such separating walls can be provided in many cases advantageously.

It is preferentially provided that the blowing directions of the blower elements are angularly adjustable exclusively in planes which extend perpendicular to the longitudinal direction of the row. In some cases, it is conceivable, however, to mount the blower elements in such a way that they have further angular pivoting capabilities, for example, to mount them in the form of ball joints.

It is suitable to develop the blower elements so that at the middle adjustment position of an individual blower element, the air jet or stream emerges perpendicular to the plane of the ceiling or wall surface which is contiguous to the air outlet. The stream direction can be adjusted to either side of this middle position within identically large angular regions.

In general, it is suitable and sufficient to provide that the blower elements are adjustable by hand, for example, by means of a pencil or the like, inserted into one of the blower slots. Of course, one can also use motorized means lifting magnets or similar means for the adjustment of the blower elements or their air-guide-means, if necessary. One can also automatically pivot the blower elements, singly, or in groups, or in some cases together, depending on the temperature of the supply air, and on the most favorable positions for the prevailing temperature.

Figure 2:
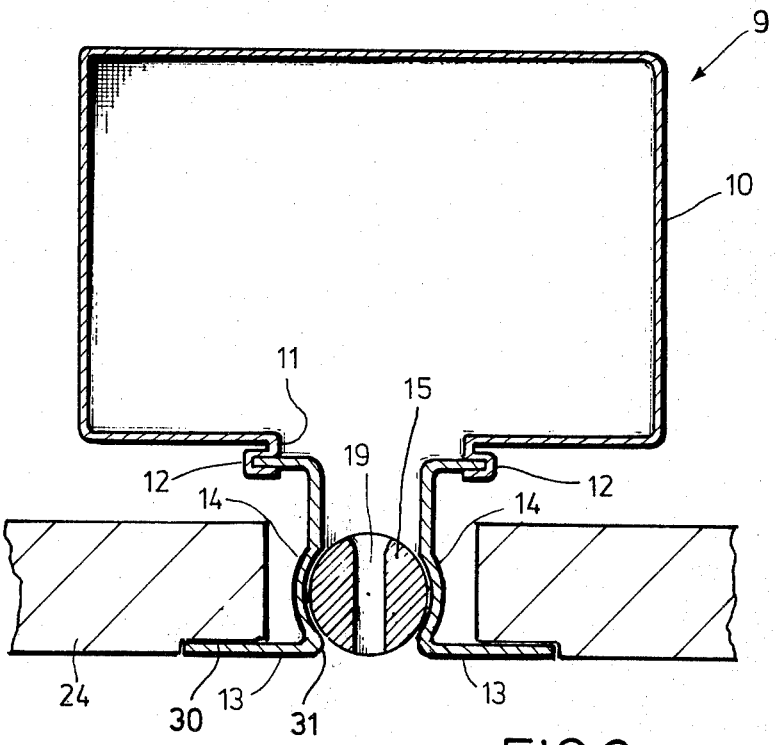
FIG. 2 illustrates a cross section through the air outlet according to FIG. 1 in an enlarged representation including a portion of an intermediate wall in which the air outlet is mounted.

Referring to FIGS. 1–3, an air outlet, designated generally by the numeral 9, includes an air chamber or main duct 10 which has a conventional inlet (not shown) for supply air and which also has along its bottom, a longitudinal slit 11 (FIG. 2) extending over its length. Longitudinal rims on the two sides of the slit 11 are provided with rebent flanges 12, each of which holds a respective U-shaped, bent sheet metal member 13; these metal members are formed to be mirror images of each other and are disposed in mirror symmetry. The lower halves of the middle sections of the sheet metal members 13 are provided with outwardly extending bent or otherwise formed portions which define bulges 14 having a cross section in the shape of a circular sector thereby forming a pair of opposed arcuate bearing cups or surfaces for mounting a plurality of blower elements 15 which are circular cylinders. The blower elements 15 are positioned coaxial with one another and are mounted in the bearing cups or surfaces defined by the bulges 14 so as to be independently rotatable.

The space between the two middle sections of the two sheet metal members 13 is terminated at both ends by extensions 16 (FIG. 1) of the two end walls of the air chamber or main duct 10 so that the metal members 13 and extensions 16 together form a longitudinal, relatively narrow hollow shaft having lower end flanges 30. The end flanges 30 are outwardly directed, with respect to one another, and are formed by outwardly bent lower legs of the sheet metal members 13, these flanges being designed for the flush attachment to an intermediary wall 24 (FIG. 2) of a room in a building, or the like.

All of the blower elements 15 are identical and are disposed in a single row, between the bearing cups or surfaces formed by the bulges 14, with their flat frontal surfaces adjacent to one another. Each of the blower elements 15 is provided with a diametrally penetrating slit 19 of substantially rectangular cross section. Each of the blower slits 19 extends nearly or substantially over the entire length of its respective blower element 15 and has an enlarged trumpet-shaped inlet orifice facing toward the air chamber or main duct 10.

The blower elements 15 are mounted in the bearing cups or surfaces formed by the bulges 14 so as to be independently rotatable about their respective geometric longitudinal axes; rotation can be effected manually by simply turning any of the blower elements 15.

The supply air chamber or main duct 10 which is shown can have a length for example of 1 to 2 meters and corresponds to the test model mentioned in the introduction to the description. The roller-like cylindrically-shaped blower elements 15 can have, for example, a length of 50 mm and a diameter of 20 mm as in the above-mentioned test model. The length of each of the blower slits 19, measured in the direction of the geometrical axis of rotation of the corresponding blower element 15 can be 48 mm. The width of each of the blower slits 19 and, therefore, the thickness of the outstreaming supply air stream can be, for example, 8 mm. The possible angular blast region of each of blower elements 19, relative to the normal to the ceiling of a room, is angularly adjustable in a range from approximately +50° to approximately −50°, for example, by means of a pencil or the like inserted in the slots 19. This pivoting angle is, however, preferably not limited by stops, so that, if desired, the blower elements 15 or any of them can also be pivoted to a greater extent to cut-off positions in which the blower slits 19 or any one of them is closed off at its inlet and at its outlet by the bearing cups or surfaces formed by the bulges 14, i.e. in which one or more of the blower slits 19 has an approximately horizontal position.

The different possibilities of adjustment of the blower elements 15 have been discussed extensively in the introduction part of this application. For example, all of the blower elements 15 can be adjusted so that their respective blower slits 19 are vertical and one can then exhaust an air stream which flows downwardly in a direction parallel to the normal to the ceiling as a kind of air curtain. Or, one can adjust all of the blower elements 15 in the position shown in solid lines in FIG. 3. In that case, the entire supply air adjoins to the ceiling 24 after flowing only a few centimeters upon leaving the blower elements 15 because of the Coanda-effect and in spite of the blast direction of the blower elements 15 which is inclined by approximately 45°, as shown in FIG. 3, to the ceiling perpendicular, indicated by line 7. Or, one can adjust, for example, three or more neighboring blower elements 15 into the position shown in solid lines in FIG. 3 and subsequently adjust three or more blower elements 15 into the position suggested by dotted lines designated by the numeral 22. In that case, supply air streams adhere to the ceiling 24 in both directions, as indicated by the arrows 23' and stream, in opposing directions, from the air outlet chamber or main duct 10 along the ceiling 24. Again, one can adjust every other blower element 15 into the position shown in solid lines in FIG. 3 and adjust the intervening blower elements 15 into the position suggested by the dotted lines designated by the numeral 22. In that case, the Coanda effect does not occur so that the supply air is blown out divergingly in the direction of arrows 23. Again, one can combine the ajdustments described, as mentioned in the introduction portion of this application, with a help of an exemplary embodiment. For example, it is possible to select the near field of the supply air stream, which is symbolized in FIG. 3 by the long arrows 23' drawn directly underneath the air outlet, and which continues into the far field, designated generally by the numeral 25, at some greater distance from the air outlet, for example, at a distance of about 1 meter, and where far field corresponds essentially to a planar 180° source stream having substantially no downwardly directed components.

As shown, the outside surface of the edge-like transition region 31 (FIG. 3) of each sheet metal member 13 is uniformly, convexly curved from the outwardly extending flange 30 to the bearing cup or surface formed by the bulge 14, this constant radius of curvature having, for example, the value of 5 mm as in the test model. This curvature enhances the creation of the Coanda-effect where one can suitably adjust the corresponding slits 19 so that the curved region 31 is contacted directly by the supply air, as is shown for example in FIG. 3, where the region 31 overlaps the exit orifice of the slit 19 by about a third of the width of the exit orifice as seen in a projection parallel to the blast direction, diagrammatically illustrated by the arrows 23. As mentioned before, because of the short length of the blower elements 15 used, the Coanda-effect occurred in the test model only when at least three neighboring blower elements were adjusted in the same sense.

FIG. 4 is a perspective view of a preferred blower element 15' which has the same diameter and the same length as the blower elements 15 shown in FIGS. 1–3, so that the air outlet shown in FIGS. 1–3 can also be equipped with the blower elements 15' of FIG. 4. The blower element 15' has a blast air slit 19' extending over its entire length and is formed, for this purpose, out of two identically-shaped, semi-cylindrical bodies 27 which are disposed in mirror symmetry towards one another, and whose cross section is a sector of the area of a circle. These semicylindrical bodies 27 are connected to one another by means of bolts 29 so that their circumferential walls are sections of a common geometrical circular cylinder. If the blower elements 15' are used in the air outlet of FIGS. 1–3, then, if the individual blower elements are adjusted to the same angular position, an air passage slit 19' is created, extending over the entire length of the air outlet. Of course, the blower elements 15'can also be adjusted independently of one another in whatever other desired different angular positions, as has already been explained in conjunction with FIGS. 1–3.

Figure 6:
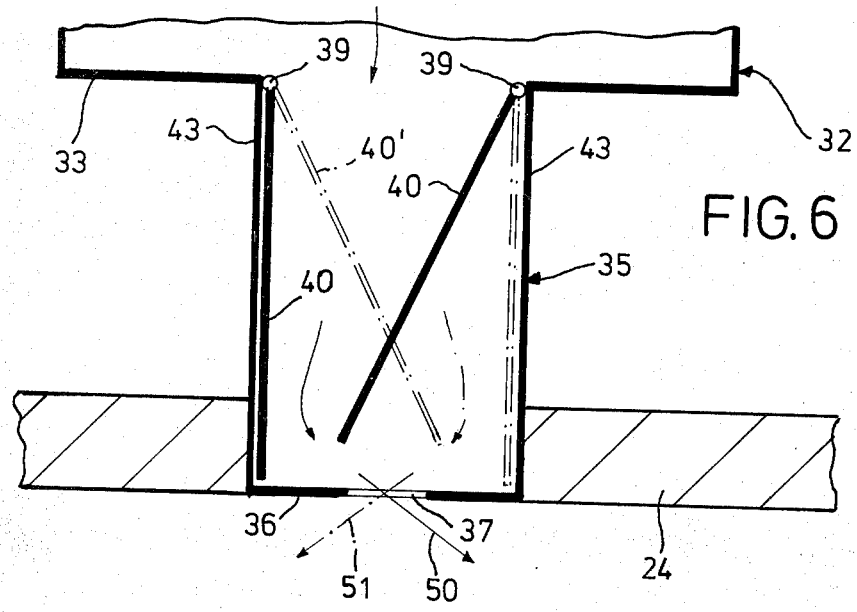
FIG. 6 illustrates an enlarged, partial sectional view taken along the line 6—6 in FIG. 5.
Figure 5:
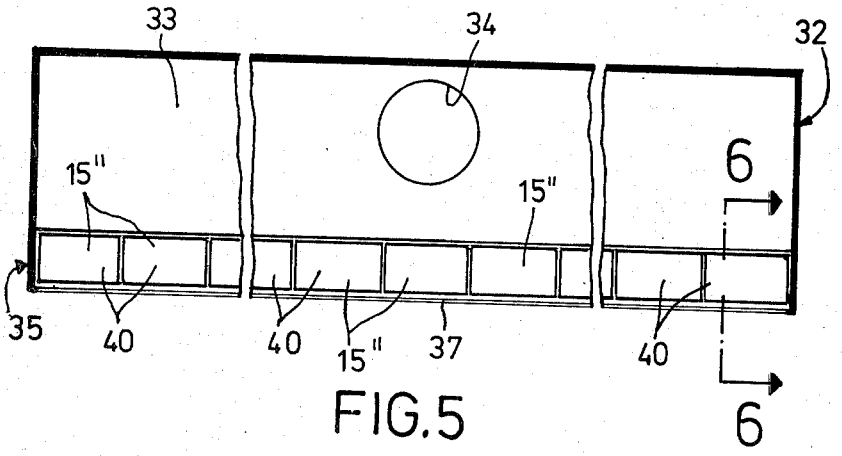
FIG. 5 illustrates a broken, longitudinal section through a box-shaped air outlet according to a further exemplary embodiment of the invention.

In the exemplary embodiment according to FIGS. 5 and 6, the air outlet shown in FIG. 5 in longitudinal section includes an air chamber or main duct 32 which has a portion 33 (FIG. 5) in the form of a rectangular solid into which a supply air inlet 34 terminates. To the main portion 33, there is connected downwardly a narrow hollow air shaft 35 of rectangular cross section, whose bottom 36 is inserted flush with an intermediary wall 24 and which has a central air passage slit 37 of rectangular shape extending over the length of this air shaft. In order to be able, in spite of the relatively long air shaft 35 and the correspondingly long slit 37, to define relatively short blower elements whose blast angle is adjustable, independently and differently from one to the other, within a relatively large angular region and where this angular region is bisected by the normal to the ceiling or wall 24, there is pivoted, at locations 39, in high frictional contact, respective rows of flat flaps 40 which, in their vertical positionings, extend to near the bottom 36 of air shaft 35. The flaps 40 in one row oppose respectively corresponding flaps 40 in the other row, defining thereby pairs of flaps. All the flaps 40 are identically constructed. If the right flap 40, as seen in FIG. 6, is adjusted to the position shown in solid lines, the supply air streams out through the oppositely lying slit 37 in the direction of arrow 50. If this flap 40 is pivoted into the vertical, ineffective position shown with dotted lines, and the left flap 40, as seen in FIG. 6, is pivoted into the angled position, shown with dotted lines, then the supply air streams out through the slit 37 in the direction of arrow 51 shown in dotted lines. If both left and right flaps 40, as seen in FIG. 6, are repositioned in their ineffective vertical positions, then the supply air streams out directly downwardly. By different adjustment of the flaps 40 disposed one after the other in the two rows, it is therefore possible to let the supply air stream out of the slit 37 in different selected directions. The length of the individual flaps 40 is chosen so that when neighboring flaps are adjusted to make the supply air streams guided by them stream out in opposite directions relative to the normal to the ceiling and in directions which are inclined to the plane of the ceiling, for example, in directions indicated by arrows 50 and 51, then the coanda-effect does not occur and therefore the two air streams stream out divergingly and obliquely downward into the room and do not adjoin to the wall or ceiling 24. If, on the other hand, several such flaps 40, which are adjacent to one another, are adjusted to be parallel to each other, for example, into the position shown in solid lines in FIG. 6, then the air stream guided by them does adjoin to the ceiling 24 in consequence of the Coanda-effect. As can be seen readily, approximately the same conditions prevail as did in the exemplary embodiment of FIGS. 1 to 3 and one can create practically the same differing exhaust conditions as in the exemplary embodiment of FIGS. 1–3 by selectively positioning the flaps 40.

In general, it is not required to dispose a separating wall parallel to the plane of FIG. 6 between the flaps 40 which define two neighboring blower elements. However, in many cases such separating walls can advantageously be provided in a manner not shown further, especially if the flaps 40 are substantially smaller than the maximum length permissible within the scope of the present invention.

As explained, in the exemplary embodiment shown in FIGS. 5 and 6, each pair of the flaps 40 consisting of two oppositely positioned ones of these flaps, together with the the corresponding region of the air shaft 35, defines a blower element, designated generally by the numeral 15''.

It is to be understood that the foregoing detailed description of preferred exemplary embodiments and the specific illustrations thereof shown in the accompanying drawings are not to be considered as limiting the spirit and scope of the present invention, the scope being defined in and by the appended claims.

What is claimed is:

1. In an air outlet through which supply air is blown into the room of a building or the like, preferably from the ceiling of the room, for controlling the occurrence of the Coanda-effect, the improvement comprising air supply means, a plurality of blower elements each having a slot formed therein and extending in the axial direction thereof through which a stream of supply air flows into the room, said blower elements being arranged so that their slots lie in at least one row when viewed in the axial direction of the blower elements, means mounting said blower elements in the room for receiving air from said air supply means, with each element being independently angularly adjustable with respect to said mounting means to supply air within a range of definite blast directions, and with the length of each individual blower element being maximally approximately 12 – 25 times greater than the thickness of the outwardly flowing stream of supply air.

2. The air outlet as defined in claim 1, wherein the length of each individual blower element is 2 – 12 times greater than the the thickness of the outwardly flowing stream of supply air.

3. The air outlet as defined in claim 1, wherein the blower elements are arranged in a single row without any separation between adjacent blower elements.

4. The air outlet as defined in claim 1, wherein the blower elements are arranged in a single row with a slight separation between adjacent blower elements.

5. The air outlet as defined in claim 1, wherein the blast directions of the blower elements are angularly adjustable exclusively in planes which extend perpendicularly to the longitudinal direction of the row defined by the blower elements.

6. The air outlet as defined in claim 1, wherein the blower elements are rotatably mounted with the axes of rotation of the blower elements of a row being preferably aligned with one another.

7. The air outlet as defined in claim 6, wherein the blower elements are developed as rollers having approximately diametral air passage apertures.

8. The air outlet as defined in claim 1, wherein in the middle position of each blower element the air stream flows outwardly in a direction perpendicular to the plane of the ceiling surface which is contiguous with the air outlet.

9. The air outlet as defined in claim 1, wherein in the middle position of each blower element the air stream flows outwardly in a direction perpendicular to the plane of the wall surface which is contiguous with the air outlet.

10. The air outlet as defined in claim 1, wherein at least any two adjacent blower elements may be arranged in such a way that their outwardly flowing air streams are approximately parallel to one another and are inclined to the plane of the ceiling so that the total outwardly flowing supply air adheres to the ceiling as a result of the Coanda-effect.

11. The air outlet as defined in claim 1, wherein at least any two adjacent blower elements may be arranged in such a way that their outwardly flowing air streams are approximately parallel to one another and are inclined to the plane of the wall so that the total outwardly flowing supply air adheres to the wall as a result of the coanda-effect.

12. The air outlet as defined in claim 1, further comprising a common air shaft for each row of blower elements, each said air shaft having at least one air outlet aperture at the bottom thereof and a plurality of air guiding flaps arranged in a row, said flaps being adjustable independently of one another and defining different ones of said blower elements.

13. The air outlet as defined in claim 12, wherein each said air shaft has a plurality of air outlet apertures at the bottom thereof.

14. The air outlet as defined in claim 12, wherein the plurality of air guiding flaps are arranged in a plurality of rows.

15. The air outlet as defined in claim 12, wherein each said air shaft is provided with separating walls between the air guiding flaps of adjacent blower elements.

16. The air outlet as defined in claim 1, wherein the outlet is installed in a ceiling approximately flush with the plane of the ceiling.

17. The air outlet as defined in claim 1, wherein the outlet is installed in a wall approximately flush with the plane of the wall.

18. The air outlet as defined in claim 1, wherein the length of a blower element is 4 – 10 times greater than the thickness of the outwardly flowing stream of supply air.

19. The air outlet as defined in claim 1, wherein the length of a blower element is preferably 5 – 7 times greater than the thickness of the outwardly flowing stream of supply air.

* * * * *